United States Patent [19]

Samuel et al.

[11] 4,393,832

[45] Jul. 19, 1983

[54] BRAKING DIESEL ENGINES

[75] Inventors: Olof Samuel, Stockholm, Sweden; Heikki Hellemaa, Åbo, Finland

[73] Assignees: Nordstjernan AB, Stockholm, Sweden; Oy Warstsila AB, Åbo, Finland

[21] Appl. No.: 276,348

[22] PCT Filed: Oct. 7, 1980

[86] PCT No.: PCT/SE80/00245

§ 371 Date: Jun. 5, 1981

§ 102(e) Date: Jun. 5, 1981

[87] PCT Pub. No.: WO81/01030

PCT Pub. Date: Apr. 16, 1981

[30] Foreign Application Priority Data

Oct. 10, 1979 [SE] Sweden ..... 7908405

[51] Int. Cl.[3] ..... F02D 35/00

[52] U.S. Cl. ..... 123/327; 123/90.14; 123/182

[58] Field of Search ..... 123/320, 321, 322, 323, 123/327, 344, 90.14, 179 F, 182; 188/273

[56] References Cited

U.S. PATENT DOCUMENTS

| | | | |
|---|---|---|---|
| 1,799,430 | 4/1931 | Loew | 123/327 X |
| 3,667,435 | 6/1972 | Bygdnes | 123/327 |
| 4,226,216 | 10/1980 | Bastenhof | 123/321 X |

*Primary Examiner*—William A. Cuchlinski, Jr.
*Attorney, Agent, or Firm*—Holman & Stern

[57] ABSTRACT

The invention relates to a method and apparatus for controlling the braking action of a diesel engine having several cylinders. Hereby valves of the cylinders are opened and closed for supplying compressed air and/or venting the cylinder during a certain moment of the compression stroke. This is accomplished by a transmitter which produces an electric pulse that is transformed into an electro-magnetic force, which controls a valve of a pressurized pilot air system for opening the valve of the particular cylinder.

10 Claims, 4 Drawing Figures

BRAKING DIESEL ENGINES

BACKGROUND OF THE INVENTION

1. Field of the Invention

The invention relates to a method and means for regulating the braking action of diesel engines with several cylinders, whereby the compression work of the compression stroke is used to produce the braking effect.

2. Description of the Prior Art

It is known to regulate the valves of a diesel engine so that the braking effect of the compression stroke is used. Compressed air may be supplied to the cylinder during a short moment at the beginning of the stroke, whereby the compression work is increased.

According to the known art very complicated means have been used to regulate this procedure by means of the ordinary valves. This means has included pressurized pilot air systems having distributing slide valves, which are regulated by turn over axis in accordance with the working face of the engine. Long pipings are included and because the valves of the cylinders for regulating the braking action are cut-off valves, which act rapidly, very often violent oscillations occur in the pilot air system, whereby the regulation of the braking action is disturbed. The object of the present invention is to simplify the means, which are needed for controlling the valves and the object is also to use as much of the ordinary compressed air starter system as possible. Furthermore, the object of the invention is to use the normal work cycle of the engine to produce a sub-pressure, which increases the braking effect.

BRIEF DESCRIPTION OF THE DRAWINGS

The characterizing features of the present invention are stated in the enclosed claims and an embodiment of the invention will be described in the following with reference to the accompanying drawings.

SUMMARY AND DESCRIPTION OF THE PREFERRED EMBODIMENTS OF THE INVENTION

Figures 1, 3:
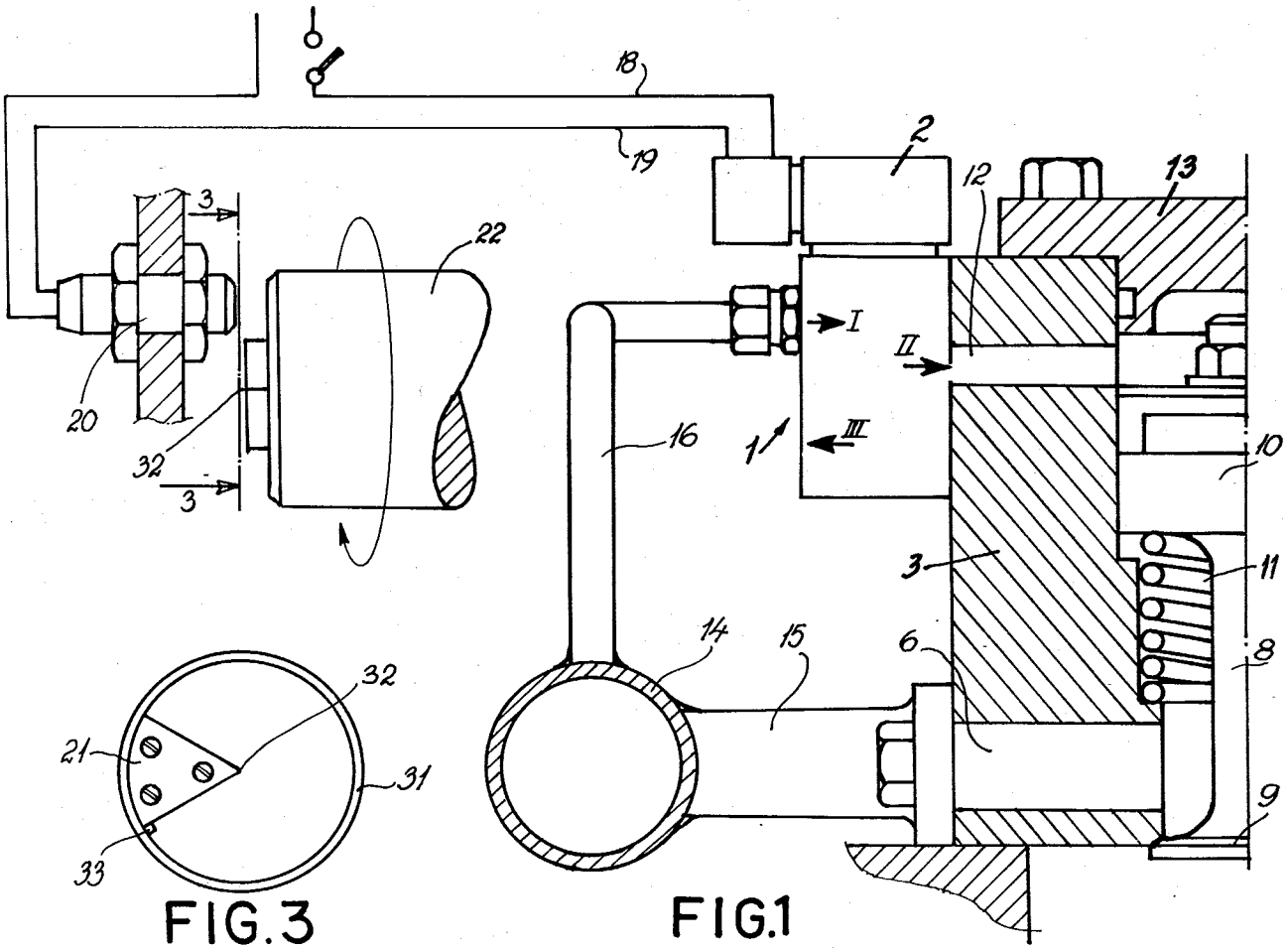
FIG. 1 is hereby a section of a part of a cylinder head to which is connected means for creating a positive pressure in the cylinder at the beginning of the compression stroke.
FIG. 3 is a sectional view of the embodiment shown in FIG. 1, taken along line 3—3.

One embodiment of the invention is described with reference to FIG. 1. Every cylinder of the engine or every second cylinder of the engine or any other number of cylinders of the engine have a servo-aggregate 1, consisting of a magnet valve 2. This servo-aggregate can control a valve which includes component parts 3, 8, 9 and 10 of the cylinder. The valve may alternatively be one of the ordinary starting valve, the safety valve or the exhaust valve of the cylinder. The operation of the servo-aggregate is thus to open the compression side of the cylinder to a supply pipe 14, 15 for the pressurized air via a channel 6 by means of said valve during a certain moment during the working phases of the cylinder. The valve illustrated in FIG. 1 is of known type, but is briefly described as follows. It includes a sleeve 3, which is inserted in a hole through the cylinder head. Within the sleeve there is a valve body consisting of a shaft 8 and a valve disc 9. The shaft 8 is in the upper end connected to a servo-piston 10, which is forced upwards by means of a compression spring 11. A space within the sleeve is provided above the servo-piston 10 and the servo air can be introduced to said space through a channel 12. The upper end of the sleeve 3 is covered by a cap 13. When servo air is supplied via the channel 12 to the upper side of the servo-piston, the valve shaft 8 and the valve disc 9 will very rapidly move downwards so that the valve opens and pressurized air passes in through the channel 6.

The very specific problem, which is solved by the present invention is to supply servo air rapidly in at the right moment in order to open the valve. This is accomplished by electric signals coming from a transmitter, which is common for the engine and which signals will reach the magnet valve 2, via circuits 18, 19, said magnet valve 2 controlling the air flow through a pipe 16 into a channel 12.

The transmitter includes several capacitance or inductive transmitters 20, which are placed in front of a sector-formed plate 21, which engages shaft 22, which shaft is placed at a right angle to the plate and which rotates at a rate which is correlated to the rotation of the crank shaft. Each transmitter is placed in eccentric relation to the axis of 22 and thus also in eccentric relation to the centre of rotation of the sector-formed plate 21. The form of the sector is shown in FIG. 1 by the section 3—3. The sector-formed plate 21 is mounted in a ring, which is suspended by a stud axis 32 via spokes (not shown). The ring 31 has a peripherical groove in which the sector-formed plate 21 is mounted. The stud axis 32 and thus the ring 31 is rotated by the shaft 22. In order to drive the plate 21 in the rotational movement of the ring, a shoulder 33 is placed in the groove of the ring. The position of the shoulder 33 thus determines the relative position of the sector-formed plate in relation to the angular position of the crank shaft and in relation to the position of the capacitive transmitter 20. The capacitive transmitter produces an electric pulse when the sector-formed plate is in front of the transmitter but as soon as the plate has passed it, the electric pulse or the signal is terminated. The supplied electric signal actuates the magnetic valve 2, which adjusts a slide so that the ports at the arrows I and II are connected and thus servo air is supplied from the branch pipe 16 via channel 12 to the upper side of the servo piston 10. Thereby the valve disc 9 is opened and pressurized air is supplied to the cylinder through the channel 6. Shortly after the cylinder piston has passed bottom dead centre, the sector formed plate 21 has passed the transmitter 20, whereby the electric signal is terminated. This means that the magnetic valve 17 occupies a different position, meaning that its slide is closing the connection between the ports at the arrows I and II and will open a connection between the ports at the arrows II and III, which results in the pressure being released above the servo-piston 10 whereby the valve comprised of parts 8, 9, 10 is closed.

No more pressurized air is thus supplied and the compression stroke will continue to be accomplished. According to what we said above, an electric signal will be delivered by the transmitter to the magnetic valve when the piston in the cylinder having said magnetic valve is in the beginning of its compression stroke.

Additionally, it is possible to arrange a second valve which includes elements 10', 9', 8', (see FIG. 2), which is controlled by means of the same type as described above and which serve to release the pressure at the end of the compression stroke in the cylinder. Several additional transmitters 22' are hereby arranged in front of a rotating sector formed plate 21' and the construction and operation is the same as has been described above. Thus, when the axis 22' is rotating the sector 21' so that its leading edge is in line with the electric transmitter 20', a signal is produced and this signal is supplied to the magnetic valve 2' via the circuits 18' and 19'. This occurs when the piston is in its top dead centre position just at the end of the compression stroke. The magnetic valve 2' opens so that servo air from the pipe 16' passes I–II and into the channel 12'. The valve disc 9' opens because of a raised pressure above the valve piston 10'. The air pressure due to the compression stroke in the cylinder will now escape via the channel 6'. As soon as possible, the electric signal will be terminated when the sector plate 21' has passed the electric transmitter 20'. Because of the downward movement of the piston in the cylinder a sub-pressure is produced and the work for creating this sub-pressure is added to the formerly produced compression work so that the total braking work will be greater than what earlier has been possible to achieve.

Figures 2, 4:
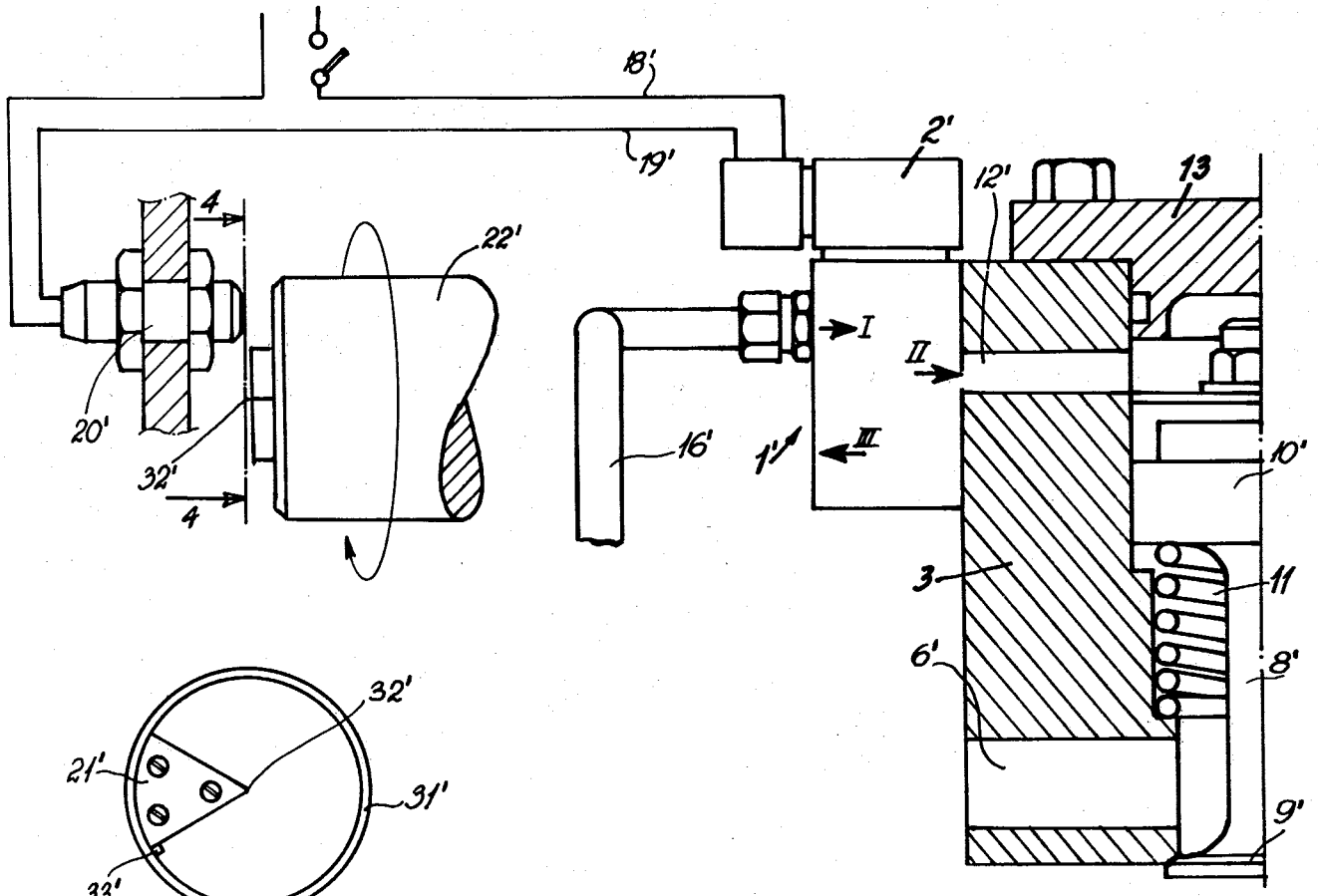
FIG. 2 is also a section of a part of a cylinder having means for creating a sub-pressure in the cylinder after the compression stroke.
FIG. 4 is a sectional view of the embodiment shown in FIG. 2, taken along line 4—4.

The two valves according to FIG. 1 and FIG. 2 may preferably be combined and the transmitters can be doubled as to their function so that one and the same system of signals and one and the same servo-system can work the two functions—supplying pressurized air just in the beginning of the compression stroke and secondly release the air pressure at the end of the compression stroke.

The transmitter can be formed according to what has been described above or in any other manner and is usually of a strong construction, which demands little maintance and which operates reliably. The circuits for producing the electric signals also operate very reliably and are not an expensive arrangement. It may not be very convenient to use the main starting valves of the cylinders for venting the air at the end of the compression stroke, but theoretically it is possible to use a type of three-way valve, which closes the connection with the starting air and which opens to the atmosphere via a damping piping system and which is controlled by the magnetic valve. An earlier mentioned alternative is to use the safety valve and open this by the magnetic valve. Still another alternative is to open the exhaust valve of the cylinder, which valve normally is closed when the piston is in its top dead centre at the end of the compression stroke. A great force is demanded to open the exhaust valve, but it is possible to use means opening the exhaust valve when the piston is at its upper dead centre.

The operation of the braking means is as follows. When the engine is to be braked, the valves for supplying fuel are closed. When the crank shaft is in such a position that the piston of a cylinder is close to its top dead centre after a compression stroke, and thus a certain amount of air has been compressed above the piston, the valve 8', 9' is opened and the compressed air will dissipate. The valve may be in the open position for a relatively short time. The opening of the valve is accomplished by the sector-formed plate which has been set in a position as described above, so that it passes that capacitive transmitter which controls the cylinder in question. The sector-formed plate rotates at the same rate as the crank shaft. The signal is thus produced and this signal is supplied via the electric circuits 18', 19' to the magnetic valve 2'. This is illustrated by the magnetic valve and the capacitance transmitter which belong to the same circuit. The electric signal is transformed in the servo-aggregate to a force which is used to open valve 8', 9' of the cylinder.

The piston of the cylinder will then move downwards and the valve is closed as well as the normal valves of the cylinder. A vacuum will thus be created during the stroke, which normally is the working stroke of the engine. After the piston has passed bottom dead centre the normal exhaust valve opens in the normal way so that the vacuum is eliminated and the pressure within the cylinder will rise to about atmospheric pressure. When the piston then passes top dead centre, the exhaust valve is closed as normal while the inlet valve opens, whereby fresh air is sucked into the cylinder when the piston descends to bottom dead centre. After the piston has passed the bottom dead centre position, the exhaust valve as well as the inlet valve are closed during following stroke. When passing the bottom dead centre the valve 8, 9, 10 is opened by means of the transmitter 20 and pressurized air is supplied to the cylinder from the pipes 14 and 15 via the channels 6 (see FIG. 1). The compression stroke is thus started from an increased pressure in the cylinder which means that the counter action on the piston will be increased during the compression stroke. When the piston reaches top dead centre a new signal will be supplied from that capacitive transmitter 20' which belongs to the cylinder and the valve 8', 9' or alternatively the exhaust valve will be opened. One braking operation is hereby completed in one cylinder. According to the four-stroke-cycle operation of the engine, all cylinders of the engine will produce a braking operation in the same way in time to the four-stroke-cycle. When the engine has many cylinders, e.g. more than twelve cylinders, two or more of the cylinders are working in the same face of the four-stroke-cycle and thus they will simultaneously produce the braking operation.

It is obvious, that the electric signals for controlling the magnetic valve may be produced by other means than those described above and for instance an ignition apparatus similar to those at usual Otto-engines can be used. It shall also be pointed out that the invention also can be adapted to two-stroke-cycle engines.

We claim:

1. In an apparatus for controlling the braking action of a diesel engine having a plurality of combustion chambers in which pressurized air is supplied tto the combustion chambers from a source of pressurized air during the compression stroke of the engine through valve means provided in the combustion chambers, each valve means having at least one conduit providing fluid communication between the source of pressurized air for introducing pressurized air to and discharging air from the valve means when in an open position, which valve means is opened by pressurized air supplied through a second conduit to a piston forming part of said valve means and slideably positioned in a cylinder located external to the combustion chamber, the improvement comprising:

a means for controlling the introduction of pressurized air to and discharge of air from the piston and cylinder, including an electro-magnetic valve placed intermediate the source of pressurized air and the cylinder, which electro-magnetic valve is adapted to be slideably moved between an open position in which air is introduced to the cylinder and a closed position in which air is discharged from the cylinder; and a means for producing an electrical signal and actuating said electro-magnetic valve including an electrical transmitter electrically connected to said electro-magnetic valve, said transmitter being operatively associated with a means for transmitting rotational motion of the engine to the transmitter, such that the electro-magnetic valve is briefly opened at approximately the commencement and conclusion of the compression stroke.

2. The apparatus according to claim 1, wherein said electrical transmitter comprises an inductive transmitter.

3. The apparatus according to claim 1, wherein said electrical transmitter comprises a capacitance transmitter.

4. The apparatus according to claim 1, wherein said rotational motion transmitting means comprises a shaft.

5. The apparatus according to claim 1, wherein said actuating means includes a sector-formed plate operatively associated with said transmitter.

6. In a method for controlling the braking action of a diesel engine having a plurality of combustion chambers in which pressurized air is supplied to the combustion chambers from a source of pressurized air during the compression stroke of the engine through valve means provided in the combustion chambers, each valve means having at least one conduit providing fluid communication between the source of pressurized air for introducing pressurized air to and discharging air from the valve means when in an open position, which valve means is opened by pressurized air supplied through a second conduit to a piston forming part of said valve means and slideably positioned in a cylinder located external to the combustion chamber, the improvement comprising:

controlling the introduction of pressurized air to and discharge of air from the piston and cylinder, by driving an electrical transmitter with a means for transmitting rotational motion of the engine, said electrical transmitter producing an electrical signal in and actuating an electromagnetic valve arranged intermediate the source of pressurized air and the cylinder, the electrical signal so produced causing said electromagnetic valve to open and admit air to the cylinder, and closing said electromagnetic valve by terminating the electrical signal and discharging air from the cylinder, such pressurized air is introduced to the combustion chambers at approximately the commencement of the compression stroke and air is discharged from the compression stroke at approximately the end of the compression stroke.

7. The method according to claim 6, wherein said electrical transmitter comprises an inductive transmitter.

8. The method according to claim 6, wherein said electrical transmitter comprises a capacitance transmitter.

9. The method according to claim 6, wherein said rotational motion transmitting means comprises a shaft.

10. The method according to claim 6, wherein said actuating means includes a sector-formed plate operatively associated with said transmitter.

* * * * *